US009791828B2

(12) United States Patent
Fujiya et al.

(10) Patent No.: US 9,791,828 B2
(45) Date of Patent: Oct. 17, 2017

(54) IMAGE FORMING APPARATUS INCLUDING A BLOWER TO PERFORM AN OPERATION BASED ON A DETECTION RESULT OF THE A DETECTOR

(71) Applicants: Hiromitsu Fujiya, Kanagawa (JP); Yasuaki Toda, Tokyo (JP)

(72) Inventors: Hiromitsu Fujiya, Kanagawa (JP); Yasuaki Toda, Tokyo (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 15/153,938

(22) Filed: May 13, 2016

(65) Prior Publication Data

US 2016/0342135 A1 Nov. 24, 2016

(30) Foreign Application Priority Data

May 19, 2015 (JP) ..... 2015-101697
Jul. 14, 2015 (JP) ..... 2015-140271

(51) Int. Cl.
*G03G 21/20* (2006.01)
*G03G 15/02* (2006.01)

(52) U.S. Cl.
CPC ..... *G03G 21/20* (2013.01); *G03G 15/0208* (2013.01); *G03G 15/0258* (2013.01); *G03G 21/206* (2013.01)

(58) Field of Classification Search
CPC ..... G03G 21/20; G03G 15/0258; G03G 15/0208; G03G 15/2016; G03G 21/206
See application file for complete search history.

(56) References Cited

U.S. PATENT DOCUMENTS

2008/0304842 A1* 12/2008 Tomiie ..... G03G 15/0266 399/50
2010/0183323 A1 7/2010 Fujiya et al.
2013/0177328 A1* 7/2013 Fukuda ..... G03G 15/0266 399/43
2014/0140713 A1* 5/2014 Miyaji ..... G03G 21/206 399/44
2015/0160609 A1* 6/2015 Seong ..... G03G 21/206 399/44

FOREIGN PATENT DOCUMENTS

JP 5-216321 8/1993
JP 2003-015485 1/2003

* cited by examiner

*Primary Examiner* — David M Gray
*Assistant Examiner* — Laura Roth
(74) *Attorney, Agent, or Firm* — Harness, Dickey & Pierce, P.L.C.

(57) ABSTRACT

An image forming apparatus includes a latent image bearer, a charger, a blower, a first detector, and a second detector. The charger charges a surface of the latent image bearer. The blower sends air to around the charger. The first detector detects a temperature of the air to be sent to around the charger. The second detector detects a temperature around the charger. The blower performs an operation based on a detection result of the first detector and a detection result of the second detector.

17 Claims, 14 Drawing Sheets

FIG. 5

| | | CHARGING CURRENT VALUE |
|---|---|---|
| TEMPERATURE AND HUMIDITY AROUND CHARGING DEVICE | HH | LOW |
| | HL | |
| | MH | |
| | ML | |
| | LH | |
| | LL | HIGH |

FIG. 6

| | | OZONE CONCENTRATION AROUND CHARGING DEVICE | | |
|---|---|---|---|---|
| | | HIGH | MODERATE | LOW |
| TEMPERATURE AROUND CHARGING DEVICE | HIGH | | | ○ |
| | MODERATE | | ○ | |
| | LOW | ○ | | |

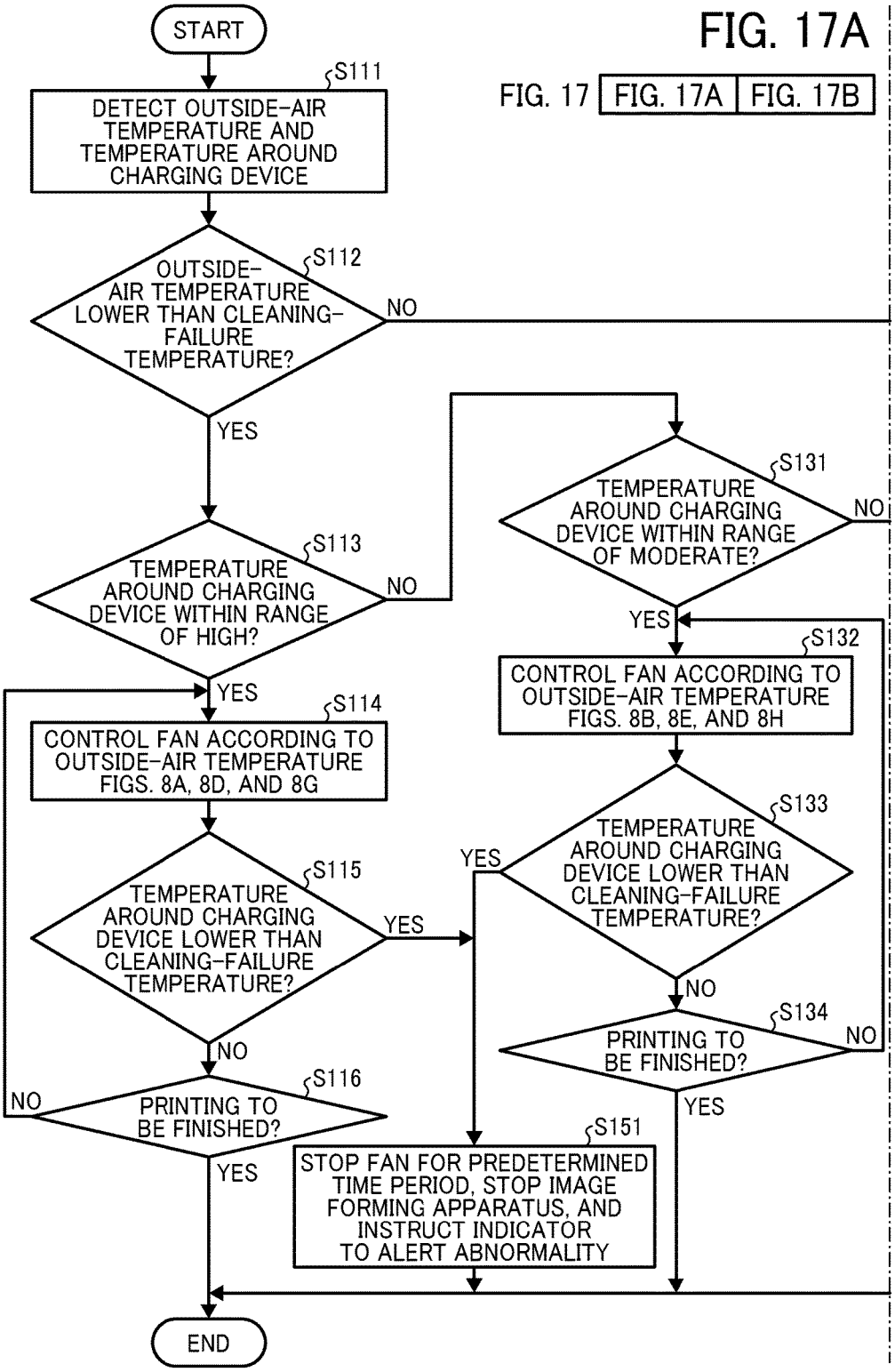
FIG. 17A
FIG. 17
FIG. 17A
FIG. 17B
START
S111
DETECT OUTSIDE-AIR TEMPERATURE AND TEMPERATURE AROUND CHARGING DEVICE
S112
OUTSIDE-AIR TEMPERATURE LOWER THAN CLEANING-FAILURE TEMPERATURE?
NO
YES
S113
TEMPERATURE AROUND CHARGING DEVICE WITHIN RANGE OF HIGH?
NO
YES
S114
CONTROL FAN ACCORDING TO OUTSIDE-AIR TEMPERATURE FIGS. 8A, 8D, AND 8G
S115
TEMPERATURE AROUND CHARGING DEVICE LOWER THAN CLEANING-FAILURE TEMPERATURE?
YES
NO
S116
PRINTING TO BE FINISHED?
NO
YES
S131
TEMPERATURE AROUND CHARGING DEVICE WITHIN RANGE OF MODERATE?
NO
YES
S132
CONTROL FAN ACCORDING TO OUTSIDE-AIR TEMPERATURE FIGS. 8B, 8E, AND 8H
S133
TEMPERATURE AROUND CHARGING DEVICE LOWER THAN CLEANING-FAILURE TEMPERATURE?
YES
NO
S134
PRINTING TO BE FINISHED?
NO
YES
S151
STOP FAN FOR PREDETERMINED TIME PERIOD, STOP IMAGE FORMING APPARATUS, AND INSTRUCT INDICATOR TO ALERT ABNORMALITY
END

IMAGE FORMING APPARATUS INCLUDING A BLOWER TO PERFORM AN OPERATION BASED ON A DETECTION RESULT OF THE A DETECTOR

CROSS-REFERENCE TO RELATED APPLICATIONS

This patent application is based on and claims priority pursuant to 35 U.S.C. §119(a) to Japanese Patent Application No. 2015-101697, filed on May 19, 2015, and Japanese Patent Application No. 2015-140271, filed on Jul. 14, 2015 in the Japan Patent Office, the entire disclosure of which is hereby incorporated by reference herein.

BACKGROUND

Technical Field

Aspects of this disclosure relate to an image forming apparatus, such as an electrophotographic multifunction peripheral, facsimile machine, or printer, including a blower.

Related Art

Image forming apparatuses, such as copiers or printers, form a toner image on a latent image bearer, transfer the toner image on a recording material, causes the recording material bearing the toner image to pass a fixing device, and fix the toner image on the recording material under heat and pressure.

Such an image forming apparatus typically employs chargers or charging rollers to form the toner image on the latent image bearer. In such an image forming apparatus, when a latent image bearer is charged with an electrostatic charger or a charging roller, ozone is generated between the latent image bearer and the electrostatic charger or the charging roller.

SUMMARY

In an aspect of this disclosure, there is provided an image forming apparatus that includes a latent image bearer, a charger, a blower, a first detector, and a second detector. The charger charges a surface of the latent image bearer. The blower sends air to around the charger. The first detector detects a temperature of the air to be sent to around the charger. The second detector detects a temperature around the charger. The blower performs an operation based on a detection result of the first detector and a detection result of the second detector.

In another aspect of this disclosure, there is provided an image forming apparatus that includes a latent image bearer, a charger, a blower, a first detector, a second detector, and a blower controller. The charger charges a surface of the latent image bearer. The blower sends air to around the charger. The first detector detects a temperature of the air to be sent to around the charger. The second detector detects a temperature around the charger. The blower controller controls an operation of the blower based on a detection result of the first detector and a detection result of the second detector.

BRIEF DESCRIPTION OF THE SEVERAL VIEWS OF THE DRAWINGS

The aforementioned and other aspects, features, and advantages of the present disclosure would be better understood by reference to the following detailed description when considered in connection with the accompanying drawings, wherein:

FIG. 5 is an illustration for describing a relationship between the temperature and the generation amount of ozone according to an embodiment;

FIG. 6 is an illustration for describing a relationship between the temperature and the ozone concentration according to an embodiment;

FIGS. 17A and 17B are a flowchart of a control procedure of the blower fan illustrated in FIG. 16 according to an embodiment.

Figure 1:
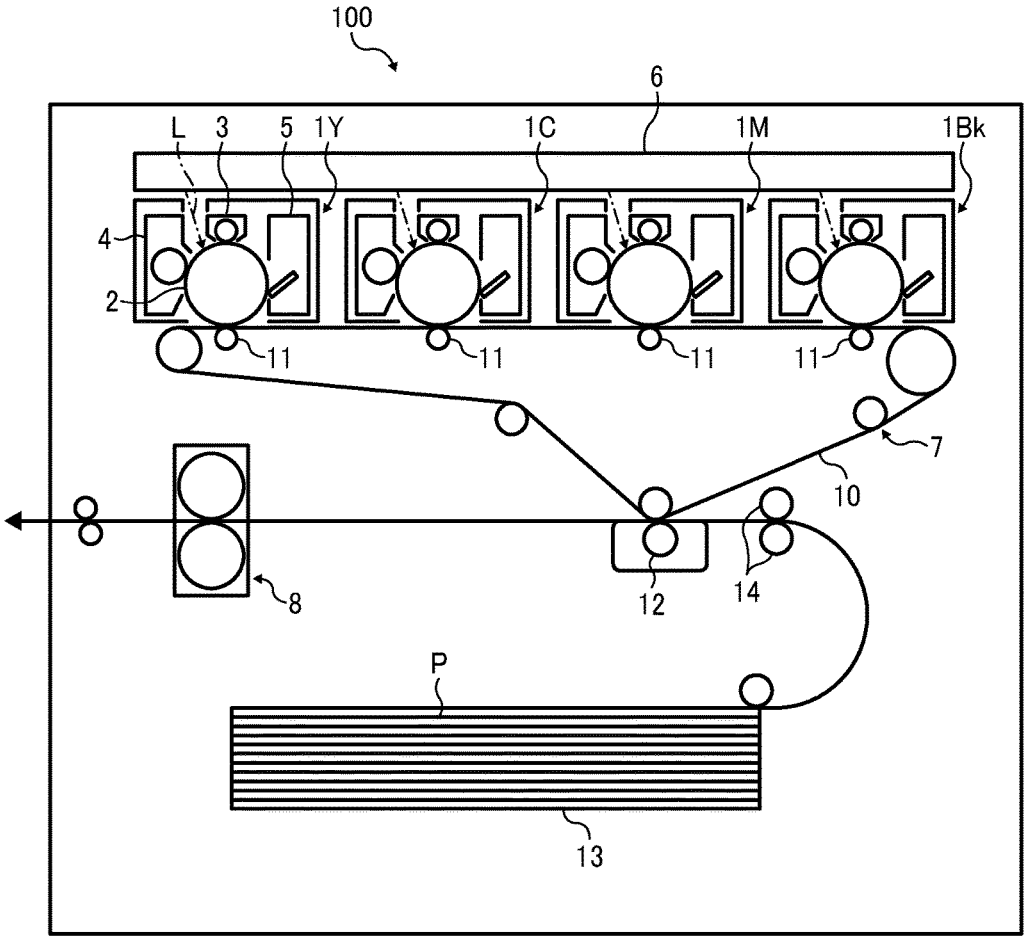
FIG. 1 is a schematic view of a configuration of an image forming apparatus according to the present embodiment.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve similar results.

Although the embodiments are described with technical limitations with reference to the attached drawings, such description is not intended to limit the scope of the disclosure and all of the components or elements described in the embodiments of this disclosure are not necessarily indispensable.

Referring now to the drawings, embodiments of the present disclosure are described below. In the drawings for explaining the following embodiments, the same reference codes are allocated to elements (members or components) having the same function or shape and redundant descriptions thereof are omitted below.

FIG. 1 is a schematic view of a configuration of a color image forming apparatus according to an embodiment of the present disclosure. First, referring to FIG. 1, general arrangement of the color image forming apparatus will be described. Examples of the image forming apparatus according to the present disclosure include a printer, a copier, a facsimile machine, and multifunction peripherals thereof, and the image forming apparatus may be a monochrome image forming apparatus, other than the color image forming apparatus.

In an image forming apparatus 100 illustrated in FIG. 1, four image forming units 1Y, 1C, 1M, and 1Bk that form images of different colors of yellow (Y), cyan (C), magenta (M), and black (Bk) corresponding to color separation components of a color image are disposed. The image forming units 1Y, 1C, 1M, and 1Bk have similar configurations except that these units store toners of different colors.

Each of the image forming units 1Y, 1C, 1M, and 1Bk includes a drum-shaped photoconductor 2 as a latent image bearer, a charging device 3 as a charger that charges a surface of the photoconductor 2, a developing device 4 that forms a toner image on the surface of the photoconductor 2, and a cleaning device 5 that cleans the surface of the photoconductor 2. In FIG. 1, the reference code is provided only to the photoconductor 2, the charging device 3, the developing device 4, and the cleaning device 5 included in the yellow image forming unit 1Y, and the reference codes are omitted in the other image forming units 1C, 1M, and 1Bk.

A writing device 6 that forms an electrostatic latent image on the surfaces of the photoconductors 2 is disposed above the image forming units 1Y, 1C, 1M, and 1Bk. Meanwhile, a transfer device 7 is disposed below the image forming units 1Y, 1C, 1M, and 1Bk.

The transfer device 7 includes an intermediate transfer belt 10 made of an endless belt as a transferor, a plurality of primary transfer rollers 11 as primary transfer devices that primarily transfer images on the photoconductors 2 to the intermediate transfer belt 10, and a secondary transfer roller 12 as a secondary transfer device that secondarily transfers the image transferred to the intermediate transfer belt 10 to a recording medium.

The intermediate transfer belt 10 is stretched around a plurality of support rollers, and round travels (rotate) as one of these support rollers is rotated as a drive roller.

Each of the primary transfer rollers 11 is disposed to be in contact with each of the photoconductors 2 through the intermediate transfer belt 10. In places where the primary transfer rollers 11 are in contact with the photoconductors 2 through the intermediate transfer belt 10, primary transfer nips where the images on the photoconductors 2 are transferred to the intermediate transfer belt 10 are formed.

The secondary transfer roller 12 is disposed to be in contact with one of the plurality of support rollers that stretch the intermediate transfer belt 10, through the intermediate transfer belt 10. In a place where the secondary transfer roller 12 is in contact with the support roller through the intermediate transfer belt 10, a secondary transfer nip where the image on the intermediate transfer belt 10 is transferred to the recording medium is formed.

Further, in the image forming apparatus 100, a sheet feeder 13 that supplies a recording medium P such as a paper or an overhead projector (OHP) sheet to the secondary transfer nip, paired timing rollers 14 for adjusting conveyance timing of the fed recording medium P, and a fixing device 8 that fixes the image to the recording medium P are disposed.

Next, an image forming operation of the image forming apparatus will be described with reference to FIG. 1. When the image forming operation is started, the photoconductors 2 of the image forming units 1Y, 1C, 1M, and 1Bk are driven, and the surfaces of the photoconductors 2 are uniformly charged to a predetermined polarity by the charging devices 3. Next, the writing device 6 irradiates the charged surfaces of the photoconductors 2 with laser light L based on image information from a reader, a computer, or the like to form electrostatic latent images. At this time, the electrostatic latent images formed on the photoconductors 2 are latent images based on single-color image information, which are obtained by decomposing a desired full-color image into color information of yellow, cyan, magenta, and black. Then, toners are supplied from the developing devices 4 to the electrostatic latent images formed on the photoconductors 2, so that the electrostatic latent images are developed as toner images (visible images).

The toner images formed on the photoconductors 2 are sequentially layered and transferred onto the intermediate transfer belt 10 that round travels. To be specific, when the images on the photoconductors 2 reach the positions of the primary transfer nips, the toner images on the photoconductors 2 are sequentially transferred onto the intermediate transfer belt 10 by transfer electric fields formed such that a predetermined voltage is applied to the primary transfer rollers 11. In this way, the surface of the intermediate transfer belt 10 bears a full-color toner image. Further, the toners on the photoconductors 2 that cannot have been transferred to the intermediate transfer belt 10 at this time are removed by the cleaning device 5.

Further, when the image forming operation is started, the recording medium P is supplied from the sheet feeder 13. The supplied recording medium P is stopped by the paired timing rollers 14 temporarily. The temporarily stopped recording medium P is sent to the secondary transfer nip between the secondary transfer roller 12 and the intermediate transfer belt 10 in a well-timed manner. At this time, a predetermined voltage is applied to the secondary transfer roller 12, and a transfer electric field is formed in the secondary transfer nip, accordingly. Then, the toner images on the intermediate transfer belt 10 are collectively transferred to the recording medium P by the transfer electric field formed in the secondary transfer nip. Following that, the recording medium P is sent to the fixing device 8, and after the toner images are fixed on the recording medium P, the recording medium P is ejected outside the apparatus.

The above description is an image forming operation when forming a full-color image on a recording medium. However, a single-color image can be formed using any one of the four image forming units 1Y, 1C, 1M, and 1Bk, or a two-color or three-color image can be formed using two or three image forming units.

As described above, when an image forming apparatus is charged with an electrostatic charger, or a charging roller, ozone may be generated between the electrostatic charger or the charging roller and the latent image bearer. Ozone reacts with moisture in the air and becomes a charged product. If such a charged product adheres to or remains on the latent image bearer, a desired charge potential cannot be obtained, and the latent image bearer is transferred to the recording material without having the toner image formed, resulting in image failure.

To overcome such failure, measures to decrease the generation amount of ozone by reducing the distance between the charging roller and the latent image bearer have been implemented. However, as the image forming apparatus become a higher-speed apparatus, the generation amount of ozone is increased and it has become more difficult to reduce the failure.

Further, to decrease the ozone concentration, a method is proposed to blow air around the charging roller. However, if the temperature around the charging roller is decreased to be lower than a predetermined temperature, cleaning failure of the latent image bearer may occur.

Figure 2:
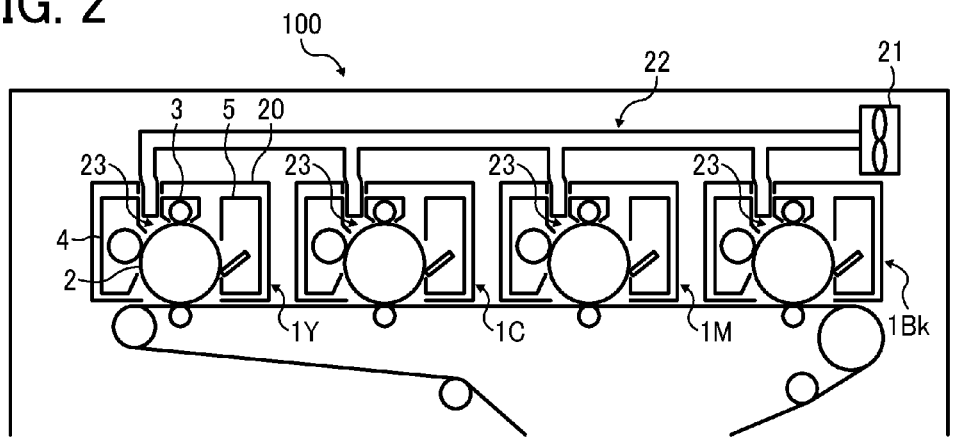
FIG. 2 is a schematic view of a configuration of a blower fan and its peripheral of the image forming apparatus illustrated in FIG. 1 according to an embodiment.

Below, a blower fan 21 and its peripheral according to the present disclosure are described with reference to FIG. 2. As illustrated in FIG. 2, in the image forming apparatus 100, the blower fan 21 as an airflow generator (blower) and a duct 22 that leads outside air to the image forming units 1Y, 1C, 1M, and 1Bk with the blower fan 21 are disposed. The duct 22 is branched into four parts to lead the outside air sent from the blower fan 21 to the image forming units 1Y, 1C, 1M, and 1Bk, and leading ends of the branched duct 22 are disposed corresponding to the image forming units 1Y, 1C, 1M, and 1Bk. Note that the blower fan 21 is not limited to the aspect that leads the outside air to the image forming units 1Y, 1C, 1M, and 1Bk, and for example, the blower fan 21 may lead the air in the image forming apparatus 100 to the image forming units 1Y, 1C, 1M, and 1Bk.

The leading ends of the duct 22 enter recessed portions 23 provided in housings 20 of the image forming units 1Y, 1C, 1M, and 1Bk, and are disposed near upper portions of the photoconductors 2, where the charging devices 3 are positioned. The recessed portions 23 where the leading ends of the duct 22 are disposed to enter are recessed portions depressed inward from surfaces of the housings 20 that hold the photoconductors 2, the charging devices 3, the developing devices 4, and the cleaning devices 5 included in the image forming unit 1Y, 1C, 1M, and 1Bk, and are formed to irradiate the photoconductors 2 with the laser light L from the writing device 6.

Figure 3:
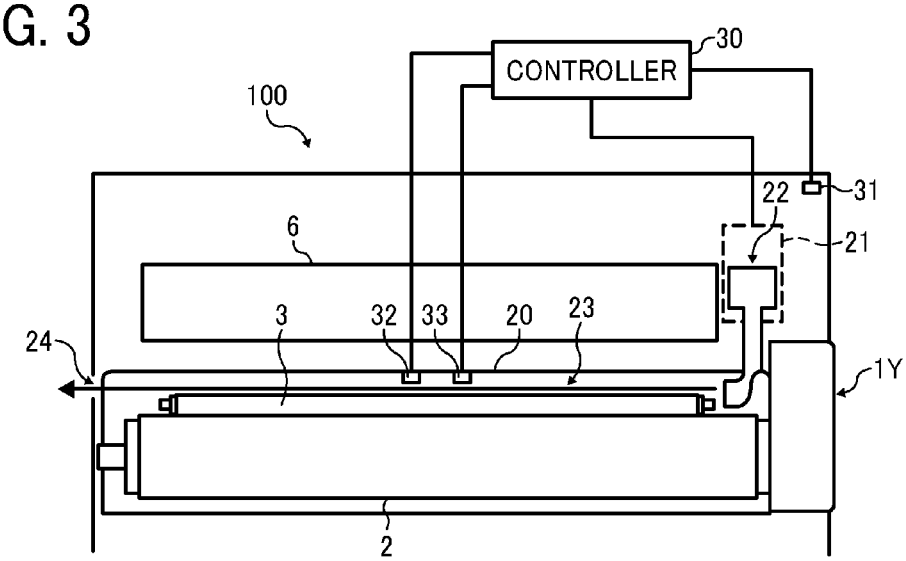
FIG. 3 is an illustration for describing the blower fan of the image forming apparatus illustrated in FIG. 1 according to an embodiment.

As illustrated in FIG. 3, the duct 22 as a whole is disposed at a front surface side (the right side in FIG. 3) of the image forming apparatus 100. When the blower fan 21 is driven in a state where the image forming units 1Y 1M, 1C, and 1Bk are inserted into an apparatus body, a generated airflow is lead to the image forming units 1Y, 1C, 1M, and 1Bk through the duct 22, and the air from the leading ends of the duct 22 are exhausted in a direction indicated by arrow of FIG. 3. In this case, the air exhausted from the leading ends of the duct 22 to the recessed portion 23 flows from a front surface side to a back surface side (insertion direction of the image forming units 1Y, 1C, 1M, and 1Bk) of the apparatus body along an axial direction above the photoconductor 2. Further, a vent 24 is provided in the back surface side of the apparatus body, and the air is exhausted through the vent 24 to an outside. Note that an air suction fan that performs air suction may be provided around the vent 24.

As described above, by causing the air to pass above the photoconductor 2 along the axial direction, ozone generated when charging the photoconductor 2 and the charged product thereof can be exhausted outside the apparatus. Therefore, adhesion of the ozone charged product to the photoconductor 2 can be suppressed. Accordingly, generation of a defective image can be prevented and a favorable image can be formed for a long period of time. FIG. 3 illustrates a flow of the air caused for the image forming unit 1Y for a yellow image. However, the image forming apparatus has flows of the air similarly caused in the other image forming units 1C, 1M, and 1Bk.

Figure 4:
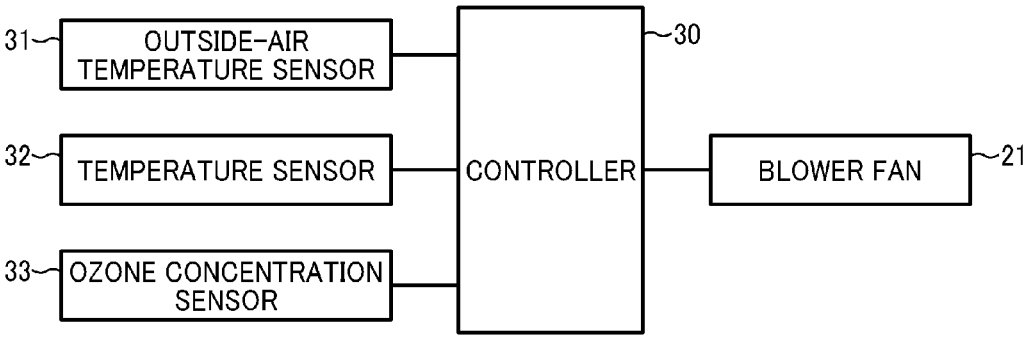
FIG. 4 is an illustration for describing a functional configuration of the blower fan according to a first embodiment of the image forming apparatus illustrated in FIG. 1.

Next, a functional configuration of the blower fan 21 according to the present embodiment will be described with reference to FIGS. 3 and 4. An outside-air temperature sensor 31 as a first detector is installed in the image forming apparatus 100, as illustrated in FIG. 3, and detects a temperature (outside-air temperature outside the image forming apparatus 100. A temperature sensor 32 as a second detector is installed above the charging device 3, and detects a temperature around the charging device 3. An ozone concentration sensor 33 as a second detector is installed above the charging device 3, and detects an ozone concentration around the charging device 3. A controller 30 inputs information detected by the outside-air temperature sensor 31, the temperature sensor 32, and the ozone concentration sensor 33, and outputs a signal for controlling driving (an amount of air) of the blower fan 21, as illustrated in FIG. 4. Note that the controller 30 may include only the temperature sensor 32. Further, the temperature sensor 32 and the ozone concentration sensor 33 may be integrally configured. Further, in a case where the blower fan 21 leads the air in the image forming apparatus 100 to the image forming units 1Y, 1C, 1M, and 1Bk, the outside-air temperature sensor 31 may be installed inside a flow channel of the air, and detect a temperature inside the image forming apparatus 100.

Next, a relationship between the temperature and the generation amount of ozone, and a relationship between the temperature and the ozone concentration will be described. FIG. 5 is a table illustrating a charging current value (horizontal axis) to each temperature and humidity (vertical axis) around the charging device 3. HH represents high temperature and high humidity, ML represents moderate temperature and low humidity, and LL represents low temperature and low humidity. As illustrated in FIG. 5, the charging current value becomes low to high as the temperature is changed from a high temperature to a low temperature. Further, the charging current value becomes low to high as the humidity is changed from a high humidity to a low humidity. The generation amount of ozone becomes larger when the charging current value is high compared with when the charging current value is low.

FIG. 6 is a table illustrating a relationship between the temperature around the charging device 3 (vertical axis) and the ozone concentration around the charging device 3 (horizontal axis). As illustrated in FIG. 6, when the temperature around the charging device 3 is low, the ozone concentration around the charging device 3 is high, and when the temperature around the charging device 3 is moderate, the ozone concentration around the charging device 3 is moderate, and when the temperature around the charging device 3 is high, the ozone concentration around the charging device 3 is low.

As described above, the amount of ozone generated from the charging device 3 is increased when the temperature around the charging device 3 is low from the relationship between the temperature and the generation amount of ozone and the relationship between the temperature and the ozone concentration. Then, the ozone concentration around the charging device 3 becomes high due to an increase in the amount of ozone. When the ozone concentration around the charging device 3 becomes high, a large amount of charged products is generated. When the photoconductor 2 is contaminated with the charged product, the photoconductors 2 are not uniformly charged, and unevenness (image blur caused by ozone) is caused in the images. To prevent the image blur caused by ozone, it is preferable to generate a large amount of airflow around the charging device 3. However, there is a disadvantage that, if the temperature around the charging device 3 is decreased to be lower than a predetermined temperature (hereinafter referred to as "cleaning failure temperature") due to the airflow generation, cleaning failure occurs.

Figure 7A:
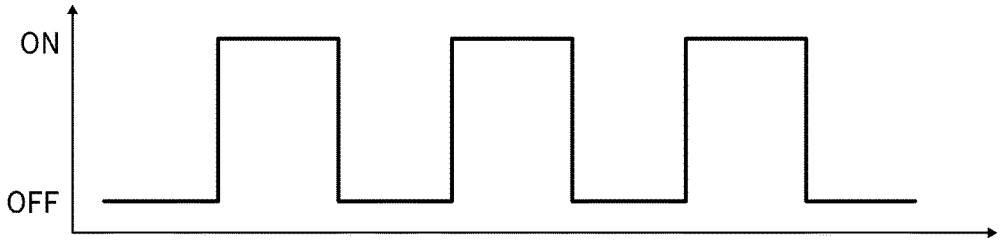
FIGS. 7A to 7D are illustrations for describing examples of drive control of the blower fan of the image forming apparatus illustrated in FIG. 1 according to an embodiment.
Figure 7B:
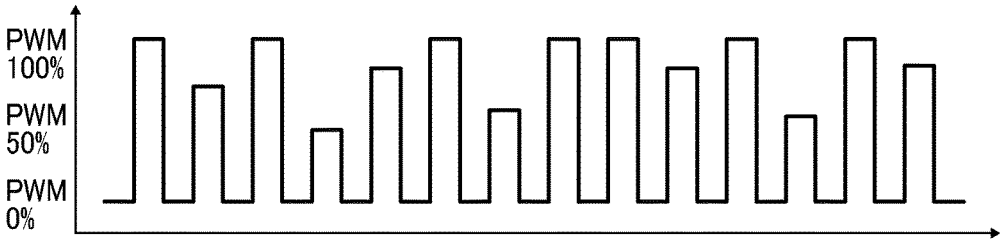
Figure 7C:
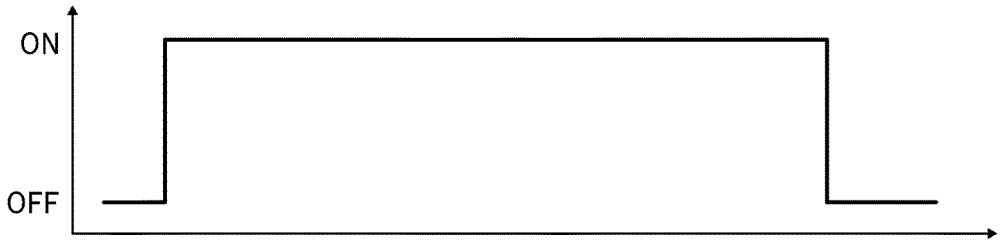
Figure 7D:
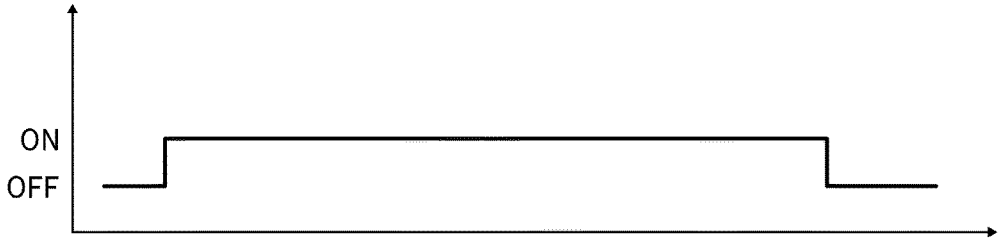

Therefore, as illustrated as examples in FIGS. 7A to 7D, the driving of the blower fan 21 is controlled by the controller 30 (FIG. 4) according to the temperature or the ozone concentration around the charging device 3. FIG. 7A illustrates that the controller 30 controls the blower fan 21 to be intermittently driven by voltage control, and FIG. 7B illustrates that the controller 30 controls the blower fan 21 to be intermittently driven by pulse width modulation (PWM) control. Further, FIG. 7C illustrates that the controller 30 controls the blower fan 21 to be continuously driven, and FIG. 7D illustrates that the controller 30 controls the blower fan 21 to be continuously driven and to a lower output than the one illustrated in FIG. 7C. Note that the blower fan 21 performs control by the voltage control but can perform fine control by the PWM control.

Figure 8:
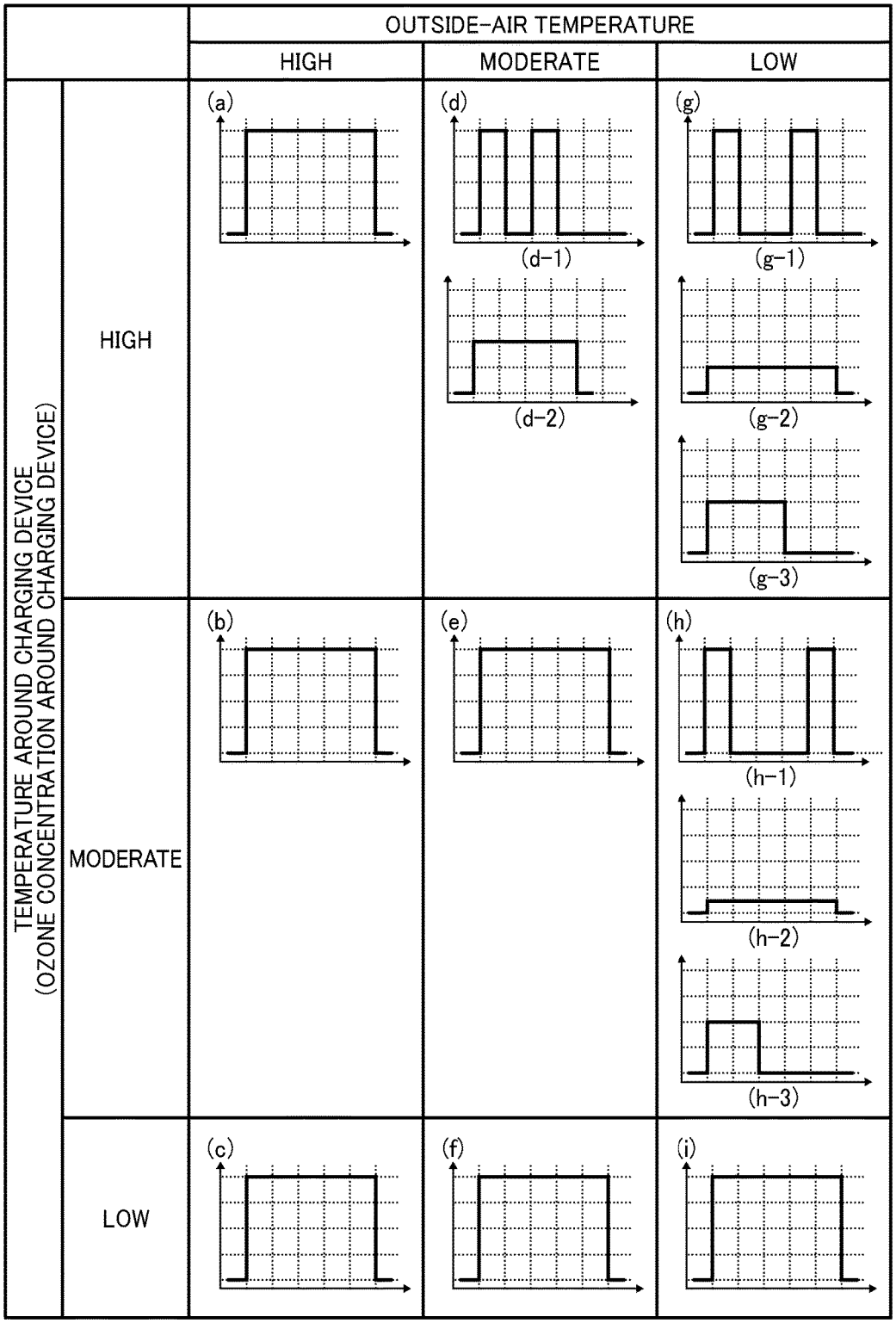
FIG. 8 is a table of examples of drive control of the blower fan of the image forming apparatus illustrated in FIG. 1 according to an embodiment.

Next, control of driving of the blower fan 21 according to the temperature or the ozone concentration around the charging device 3 will be described. FIG. 8 is a table of examples of operations of the blower fan 21. The vertical axis of each graph of (a) through (i) represents a temperature range based on a detected temperature around the charging device 3 by the temperature sensor 32. The horizontal axis of each graph of (a) through (i) represents a temperature range based on a detection result of the outside-air temperature sensor 31. Note that the vertical axis may represent the ozone concentration around the charging device 3 by the ozone concentration sensor 33.

Note that the temperature around the charging device 3 being high refers to a certain constant range of the temperature, the temperature around the charging device 3 being moderate refers to a certain constant range of the temperature that is lower than the temperature of the being high. Further, the temperature around the charging device 3 being low refers to a certain constant range of the temperature that is lower than the temperature of the being moderate.

Further, the outside-air temperature being high refers to a certain constant range of the temperature, and the outside-air temperature being moderate refers to a certain constant range of the temperature that is lower than the temperature of the being high. Further, the outside-air temperature being low refers to a certain constant range of the temperature that is lower than the temperature of the being moderate. Further, the ozone concentration around the charging device 3 being high refers to a certain constant range of the ozone concentration, and the ozone concentration around the charging device 3 being moderate refers to a certain constant range of the ozone concentration that is lower than the ozone concentration of the being high. Further, the ozone concentration around the charging device 3 being low refers to a certain constant range of the ozone concentration that is lower than the ozone concentration of the being moderate and is higher than a reference value of the ozone concentration.

In (a) through (i) of FIG. 8, the high, moderate, and low ranges on the vertical axis and the horizontal axis are illustrated as the same ranges. Note that the ranges are classified into high, moderate, and low ranges for simplification. However, the classification is not limited thereto, and two ranges, or four or more ranges may be employed, or determination may be made using a numerical value of a detection result. Further, intervals between the broken lines on the vertical axis and the horizontal axis in (a) through (i) of FIG. 8 are equal.

Figure 9:
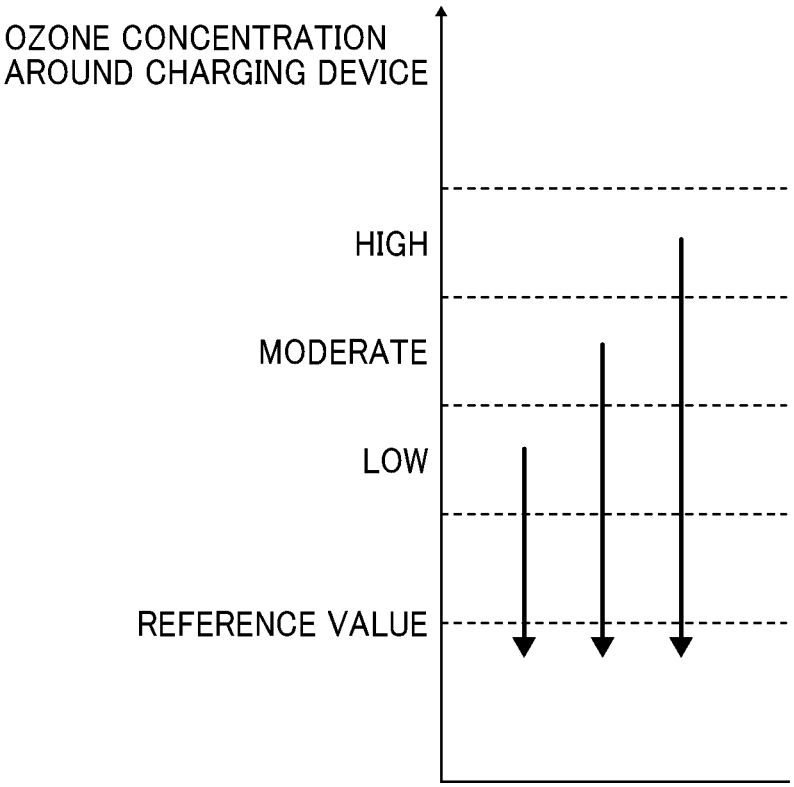
FIG. 9 is an illustration for describing the ozone concentration around a charging device of the image forming apparatus illustrated in FIG. 1 and a reference value according to an embodiment.

FIG. 9 illustrates a relationship between the ozone concentration around the charging device 3, which has been detected by the ozone concentration sensor 33, and the reference value of the ozone concentration around the charging device 3. Any of the high, moderate, and low ranges of the ozone concentration around the charging device 3 takes a value higher than the reference value of the ozone concentration.

To cause the ozone concentration around the charging device 3 to become the reference value or less, the controller 30 controls the driving of the blower fan 21 according to the temperature or the ozone concentration around the charging device 3, as an example of the present embodiment described below.

As illustrated in (a), (b), (c), (e), (f), and (i) of FIG. 8, when the outside-air temperature detected by the outside-air temperature sensor 31 is in a higher range than or the same range as the temperature around the charging device 3, which has been detected by the temperature sensor 32, even if the blower fan 21 sends the outside air to around the charging device 3, the temperature around the charging device 3 cannot be lower than the temperature of before the outside air is sent. Therefore, even if the blower fan 21 is continuously driven to decrease the ozone concentration, the temperature around the charging device 3 cannot be a cleaning failure temperature. Therefore, the controller 30 performs control of continuously driving the blower fan 21 with a constant output.

As illustrated in (d) of FIG. 8, in the case where the temperature around the charging device 3 is in the high range and the outside-air temperature is in the moderate range, the controller 30 performs control of intermittently driving the blower fan 21. For example, as illustrated in (d-1) of FIG. 8, the output value of the blower fan 21 is set to be the same as the output values illustrated in (a), (b), (c), (e), (f), and (i) of FIG. 8, and a time to perform the driving (a cumulative time of the driving) and a stop time (a cumulative time of stopping) are set to be the same. It is preferable to set the stop time of the blower fan 21 to a time during which the cleaning failure due to a decrease in the temperature does not occur. Note that the controller 30 may perform control of continuously driving the blower fan 21 with an output value that is half of the output values illustrated in (a), (b), (c), (e), (f), and (i) of FIG. 8, as illustrated in (d-2) of FIG. 8, instead of performing control of intermittently driving the blower fan 21.

As illustrated in (g) of FIG. 8, when the temperature around the charging device 3 is in the high range and the outside-air temperature is in the low range, the controller 30 performs control of intermittently driving the blower fan 21. For example, as illustrated in (g-1) of FIG. 8, the controller 30 performs control of setting the drive time in the intermittent driving of the blower fan 21 to be the same as the time illustrated in (d-1) of FIG. 8, and setting the stop time to be longer than the time illustrated in (d-1) of FIG. 8. Note that the controller 30 may perform control of setting the drive time in the intermittent driving of the blower fan 21 to be shorter than the drive time illustrated in (d-1) of FIG. 8, and setting the stop time to become the same as (d-1) of FIG.

8. Further, instead of performing control of intermittently driving the blower fan 21, the controller 30 may perform control of continuously driving the blower fan 21 with a value smaller than the output illustrated in (d-2) of FIG. 8, as illustrated in (g-2) of FIG. 8. Further, as illustrated in (g-3) of FIG. 8, the output in the intermittent driving of the blower fan 21 may be made smaller than the output illustrated in (g-1) of FIG. 8, instead of the drive time in the intermittent driving of the blower fan 21 being made larger than the drive time illustrated in (g-1) of FIG. 8. It is preferable to set the stop time, the continuous drive time, and the output value of the blower fan 21 to times and a value with which the cleaning failure due to a decrease in the temperature does not occur.

As illustrated in (h) of FIG. 8, when the temperature around the charging device 3 is in the moderate range and the outside temperature is in the low range, the controller 30 performs control of intermittently driving the blower fan 21. For example, as illustrated in (h-1) of FIG. 8, the controller 30 performs control of setting the drive time in the intermittent driving of the blower fan 21 to be the same as the time illustrated in (g-1) of FIG. 8, and setting the stop time to be longer than the time illustrated in (g-1) of FIG. 8. Note that the controller 30 may perform control of setting the drive time in the intermittent driving of the blower fan 21 to be shorter than the drive time illustrated in (g-2) of FIG. 8, and setting the stop time to be the same as (g-1) of FIG. 8. Further, instead of performing control of intermittently driving the blower fan 21, the controller 30 may perform control of continuously driving the blower fan 21 with a value smaller than the output illustrated in (g-2) of FIG. 8, as illustrated in (h-2) of FIG. 8. Further, as illustrated in (h-3) of FIG. 8, the output value in the intermittent driving of the blower fan 21 may be made smaller than the output value illustrated in (h-1) of FIG. 8, instead of the drive time in the intermittent driving of the blower fan 21 being made larger than the drive time illustrated in (h-1) of FIG. 8. It is preferable to set the stop time, the continuous drive time, and the output value of the blower fan 21 to times and a value with which the cleaning failure due to a decrease in the temperature does not occur.

Next, referring to the flowcharts of FIGS. 10 to 14, a control procedure of the blower fan 21 according to the first embodiment will be described. The flowcharts merely describe an example of a routine that can provide the function and effect of the present disclosure in the present embodiment, and it is apparent that other flowcharts are applicable as long as the flowcharts can provide the function and effect of the present disclosure.

Figure 10:
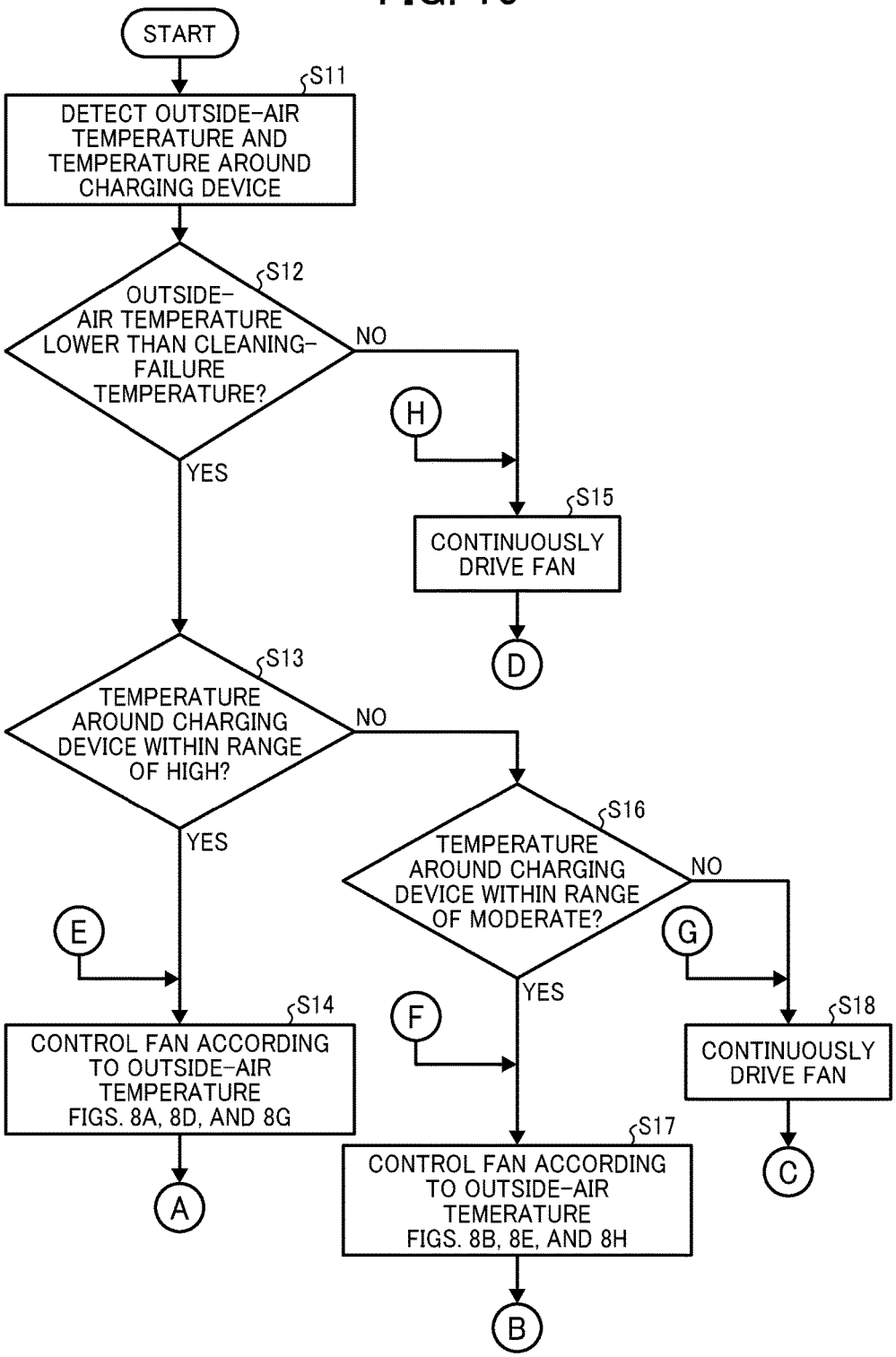
FIG. 10 is a flowchart for describing a control procedure of the blower fan according to the first embodiment of the image forming apparatus illustrated in FIG. 1.

As illustrated in FIG. 10, the printing operation is started, and the outside-air temperature by the outside-air temperature sensor 31 and the temperature around the charging device 3 by the temperature sensor 32 are detected (step S11). The printing operation being started is when information of the print instruction is received from an output device, when the image forming operation is started, or when the feeding operation of the sheet feeder 13 is started. Next, the controller 30 determines whether the detected outside-air temperature is lower than the cleaning failure temperature (step S12). Note that the cleaning failure temperature refers to a temperature around the cleaning device 5 at which the cleaning device 5 causes the cleaning failure.

When the controller 30 has determined that the detected outside-air temperature is not lower than the cleaning failure temperature, the controller 30 controls the blower fan 21 to be continuously driven step S15), and the processing proceeds to D. Meanwhile, when the controller 30 has determined that the detected outside-air temperature is lower than the cleaning failure temperature, the controller 30 determines whether the temperature around the charging device 3 is in the high range (step S13).

When the controller 30 has determined that the temperature around the charging device 3 is in the high range, the controller 30 controls, as illustrated in (a), (d), and (g) of FIG. 8, the blower fan 21 based on the detected outside-air temperature (step S14), and the processing proceeds to A. Meanwhile, when the controller 30 has determined that the temperature around the charging device 3 is not in the high range, the controller 30 determines whether the temperature around the charging device 3 is in the moderate range (step S16).

When the controller 30 has determined that the temperature around the charging device 3 is in the moderate range, the controller 30 controls, as illustrated in (b), (e), and (h) of FIG. 8, the blower fan 21 based on the detected outside-air temperature (step S17), and the processing proceeds to B. Meanwhile, when the controller 30 has determined that the temperature around the charging device 3 is not in the moderate range, the controller 30 controls the blower fan 21 to be continuously driven (step S18), and the processing proceeds to C.

Figure 11:
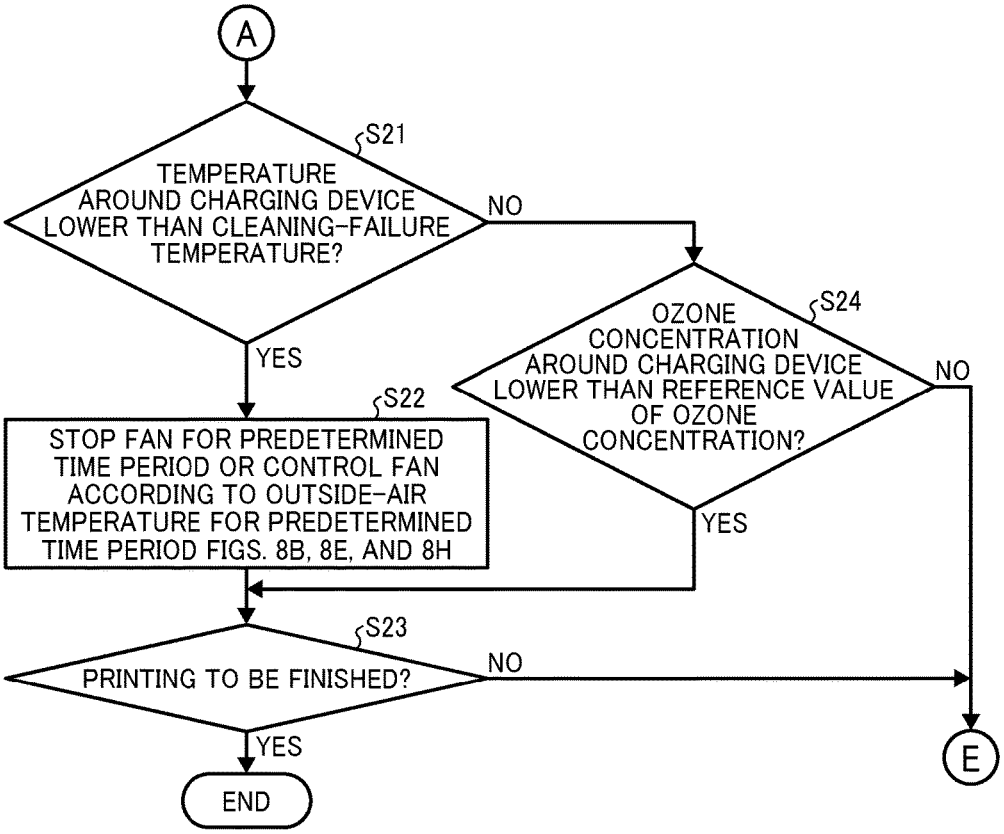
FIG. 11 is a flowchart for describing a control procedure of the blower fan according to the first embodiment of the image forming apparatus illustrated in FIG. 1.

When processing has proceeded to A, the controller 30 determines, as illustrated in FIG. 11, whether the temperature around the charging device 3 detected at every predetermined time is lower than the cleaning failure temperature (step S21).

When the controller 30 has determined that the temperature around the charging device 3 is lower than the cleaning failure temperature, the controller 30 stops the blower fan 21 for a predetermined time, or controls, as illustrated in (b), (e), and (h) of FIG. 8, the blower fan 21 for a predetermined time based on the outside-air temperature (step S22), and the processing proceeds to step S23. Meanwhile, when the controller 30 has determined that the temperature around the charging device 3 is not lower than the cleaning failure temperature, the controller 30 determines whether the ozone concentration around the charging device 3 is lower than an ozone concentration reference value (FIG. 9) (step S24). When the controller 30 has determined that the ozone concentration around the charging device 3 is lower than the ozone concentration reference value, the processing proceeds to step S23. When the controller 30 has determined that the ozone concentration around the charging device 3 is not lower than the ozone concentration reference value, the processing proceeds to E. The determination as to whether the ozone concentration around the charging device 3 is lower than the ozone concentration reference value may be determined by the controller 30 from the detection value of the ozone concentration sensor 33, or may be determined by the controller 30 from a calculation value that associates the detection temperature of the temperature sensor 32 with the ozone concentration.

The processing proceeds to step and whether the printing is terminated is determined. When the printing has been determined to be terminated, the printing operation is terminated. Meanwhile, when the printing operation has been determined not to be terminated, the processing proceeds to E.

Figure 12:
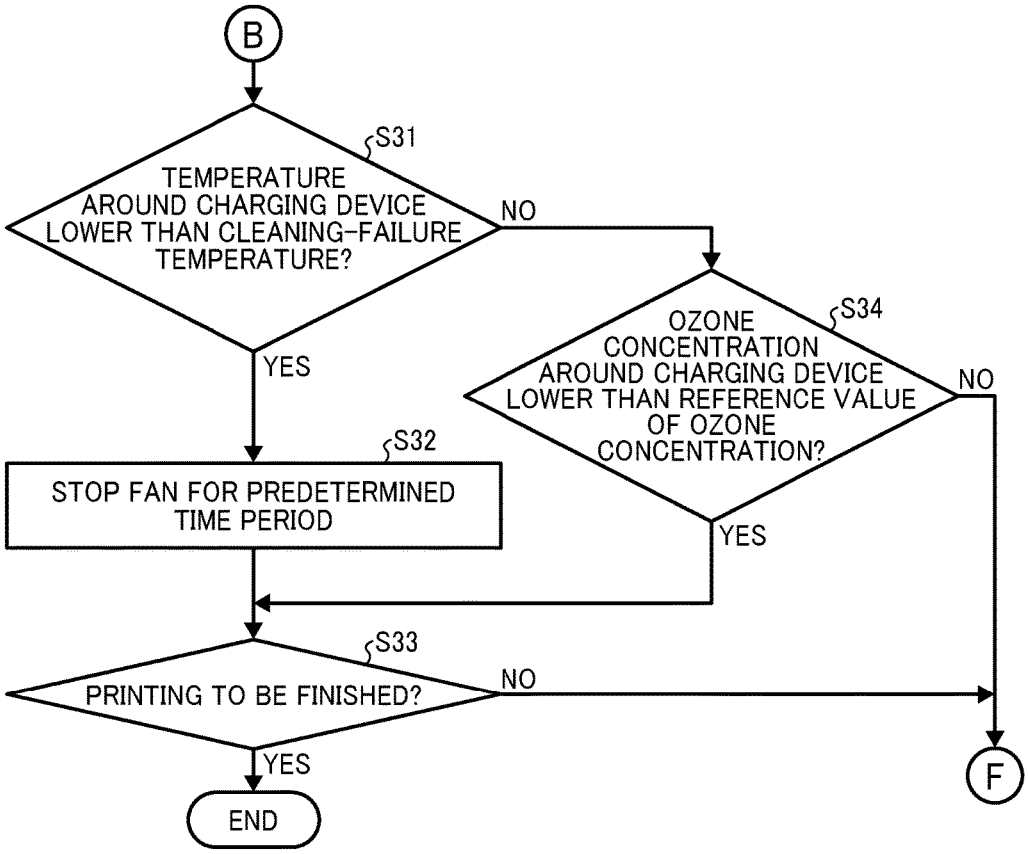
FIG. 12 is a flowchart for describing a control procedure of the blower fan according to the first embodiment of the image forming apparatus illustrated in FIG. 1.

When the processing proceeds to B, the controller 30 determines whether the temperature around the charging device 3 is lower than the cleaning failure temperature, as illustrated in FIG. 12 (step S31).

When the controller 30 has determined that the temperature around the charging device 3 is lower than the cleaning failure temperature, the controller 30 stops the blower fan 21 for a predetermined time (step S32), and the processing proceeds to step S33. Meanwhile, when the controller 30 has determined that the temperature around the charging device 3 is not lower than the cleaning failure temperature, the controller 30 determines whether the ozone concentration around the charging device 3 is lower than the ozone concentration reference value (step S34). When the controller 30 has determined that the ozone concentration around the charging device 3 is lower than the ozone concentration reference value, the processing proceeds to step S33. When the controller 30 has determined that the ozone concentration around the charging device 3 is not lower than the ozone concentration reference value, the processing proceeds to F.

The processing proceeds to step S33, and whether the printing is terminated is determined. When the printing has been determined to be terminated, the printing operation is terminated. Meanwhile, when the printing operation has been determined not to be terminated, the processing proceeds to F.

Figure 13:
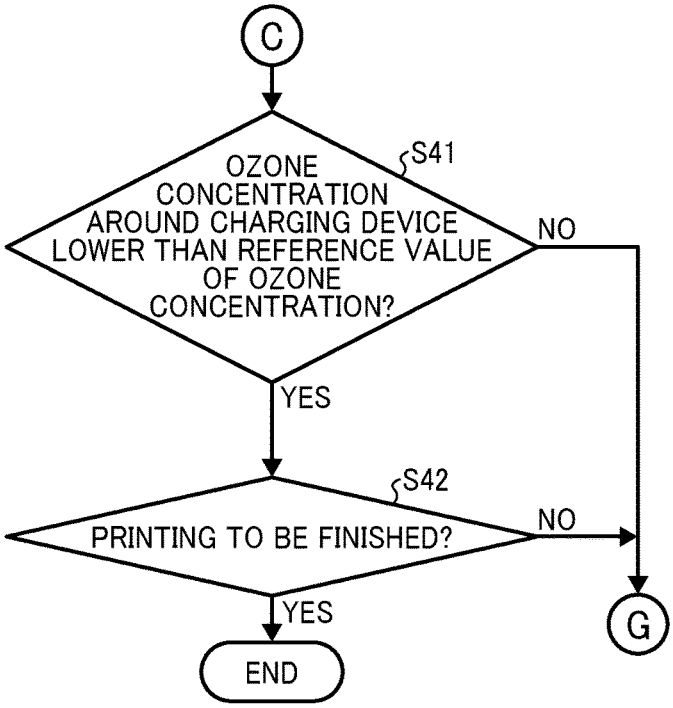
FIG. 13 is a flowchart for describing a control procedure of the blower fan according to the first embodiment of the image forming apparatus illustrated in FIG. 1.

When the processing proceeds to C, the controller 30 determines, as illustrated in FIG. 13, whether the ozone concentration around the charging device 3 is lower than the ozone concentration reference value (step S41). When the controller 30 has determined that the ozone concentration around the charging device 3 is lower than the ozone concentration reference value, the processing proceeds to step S42. When the controller 30 has determined that the ozone concentration around the charging device 3 is not lower than the ozone concentration reference value, the processing proceeds to G.

The processing proceeds to step S42, and whether the printing is terminated is determined. When the printing has been determined to be terminated, the printing operation is terminated. Meanwhile, when the printing operation has been determined not to be terminated, the processing proceeds to G.

Figure 14:
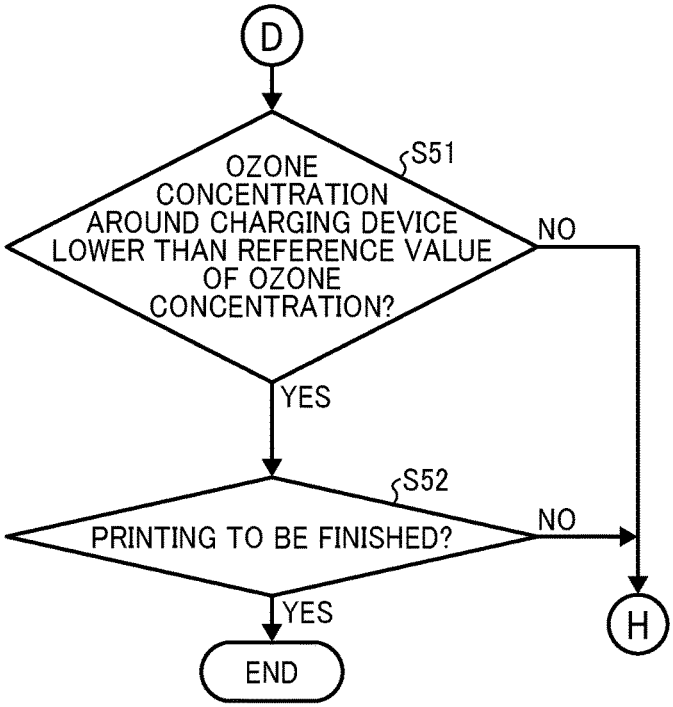
FIG. 14 is a flowchart for describing a control procedure of the blower fan according to the first embodiment of the image forming apparatus illustrated in FIG. 1.

When the processing proceeds to D, the controller 30 determines, as illustrated in FIG. 14, whether the ozone concentration around the charging device 3 is lower than the ozone concentration reference value (step S51). When the controller 30 has determined that the ozone concentration around the charging device 3 is lower than the ozone concentration reference value, the processing proceeds to step S52. When the controller 30 has determined that the ozone concentration around the charging device 3 is not lower than the ozone concentration reference value, the processing proceeds to H.

The processing proceeds to step S52, and when the printing has been determined to be terminated, the printing operation is terminated. Meanwhile, when the printing operation has been determined not to be terminated, the processing proceeds to H.

As illustrated in FIG. 10, when the processing proceeds to E, the processing returns to step S14. When the processing proceeds to F, the processing returns to step S17. When the processing proceeds to G, the processing returns to step S18. When the processing proceeds to H, the processing proceeds to step S15.

Figure 15:
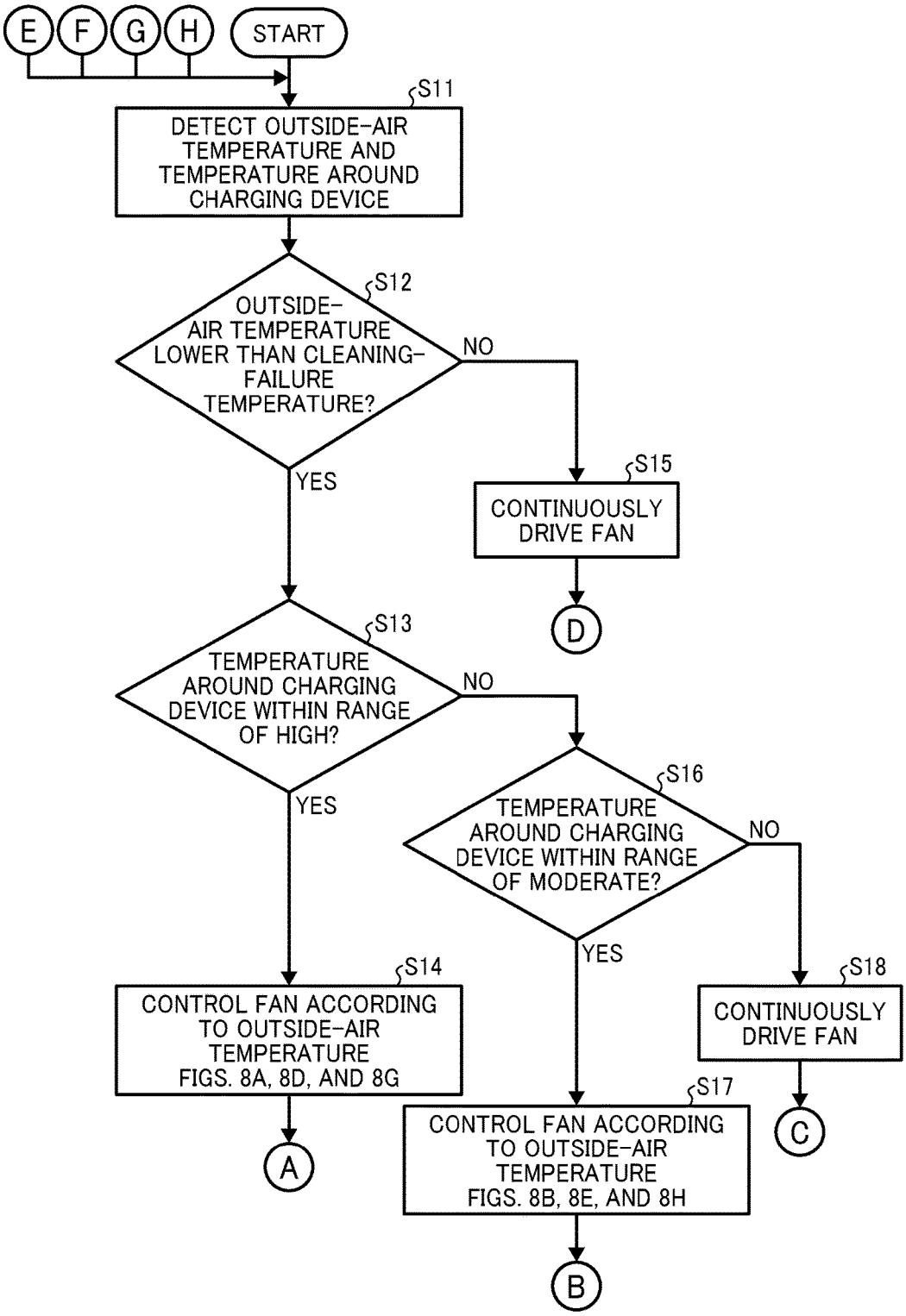
FIG. 15 is a flowchart for describing a control procedure of the blower fan according to the first embodiment of the image forming apparatus illustrated in FIG. 1.

Note that the control procedure of the blower fan 21 is not limited to FIGS. 10 to 14. For example, the flowchart of FIG. 15 may be employed in place of the flowchart of FIG. 10, and when the processing proceeds to E, F, G, and H illustrated in FIGS. 11 to 14, the processing may return to step S11 illustrated in FIG. 15.

Further, the present embodiment employs the configuration to send the air from one blower fan 21 to the image forming unit 1Y, 1C, 1M, and 1Bk. Therefore, it is more effective if the operations of the fan illustrated in FIGS. 10 to 15 are controlled based on a detection result of the image forming unit 1Y, 1C, 1M, or 1Bk having the highest ozone concentration.

Next, the function and effect of the above-described embodiment will be described. The controller 30 controls the blower fan 21, as described above, based on the detection values of the outside-air temperature sensor 31, the temperature sensor 32, and/or the ozone concentration sensor 33. Accordingly, the ozone concentration can be reduced and occurrence of the image failure can be prevented without causing the cleaning failure of the photoconductors.

In the present embodiment, the numbers of the duct 22 that leads the air to the image forming units 1Y, 1C, 1M, and 1Bk and the blower fan 21 are not limited to one. For example, a blower fan 21 and a duct 22 may be provided to the image forming unit 1Bk of the image forming units 1Y, 1C, 1M, and 1Bk, and another one blower fan 21 and a common duct 22 that leads the air from the blower fan 21 to the image forming units 1Y, 1C, and 1M may be provided to the image forming units 1Y, 1C, and 1M. Further, two blower fans 21 and two ducts 22 are provided, and one blower fan 21 and one duct 22 may be used for two of the image forming units 1Y, 1C, 1M, and 1Bk. When the air is sent from one blower fan 21 to the plurality of image forming units 1Y, 1C, 1M, and 1Bk in this way, it is preferable to control the operation of the blower fan 21 based on the detection result (detection by the ozone concentration sensor) of the image forming unit having the highest ozone concentration. For example, it can be said that the image forming unit 1Y, 1C, 1M, or 1Bk having the lowest temperature around the charging device 3 has the highest ozone concentration from FIG. 6, and thus in step S11, determination is made using the temperature detection result around the charging device 3 of the image forming unit 1Y, 1C, 1M, or 1Bk having the lowest temperature around the charging device 3. Further, in steps S24, S34, S41, and S51, determination is made using the ozone concentration detection result of the image forming unit 1Y, 1C, 1M, or 1Bk having the highest ozone concentration. Accordingly, finer control than the first embodiment can be performed. Further, the ducts 22 and the blower fans 21 may be provided independently of one another with respect to the image forming units 1Y, 1C, 1M, and 1Bk. In this case, the controller 30 can separately control the image forming units 1Y, 1C, 1M, and 1Bk. Therefore, when the ozone concentration varies in each of the image forming units 1Y, 1C, 1M, and 1Bk, the blower fans 21 can be independently controlled and thus finer control can be performed.

Figure 16:
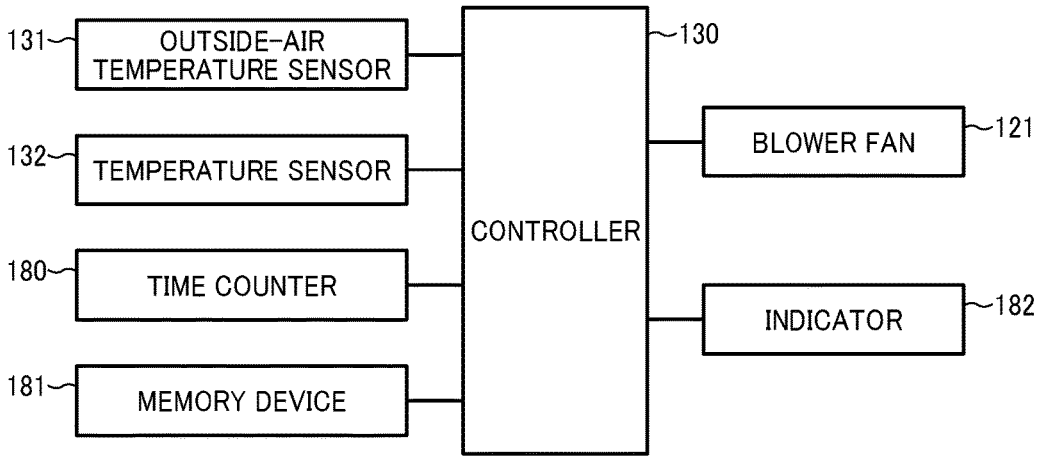
FIG. 16 is an illustration for describing a functional configuration of a blower fan according to a second embodiment of the image forming apparatus illustrated in FIG. 1.

Next, a second embodiment will be described with reference to FIGS. 16 and 17.

In the present embodiment, a blower fan is controlled with detection results of an outside-air temperature sensor and a temperature sensor without using an ozone concentration sensor.

First, a functional configuration of a blower fan 121 according to the present embodiment will be described with reference to FIG. 16. To a controller 130, information of an outside-air temperature detected by an outside-air temperature sensor 131 as a first detector, information of a temperature around a charging device 3, which has been detected by a temperature sensor 132 as a second detector, information of a drive time of the blower fan 121, which has been measured by a time counter 180, stored information of a memory device 181 are input. The controller 130 controls driving of the blower fan 121 and/or an indicator 182 based on the information. Note that the indicator 182 is a known indicator that displays an abnormal state on an operation screen of an image forming apparatus 100, or notifies abnormality by emission of an illuminous body (for example, a display in JP-2000-132009-A).

Figure 17B:
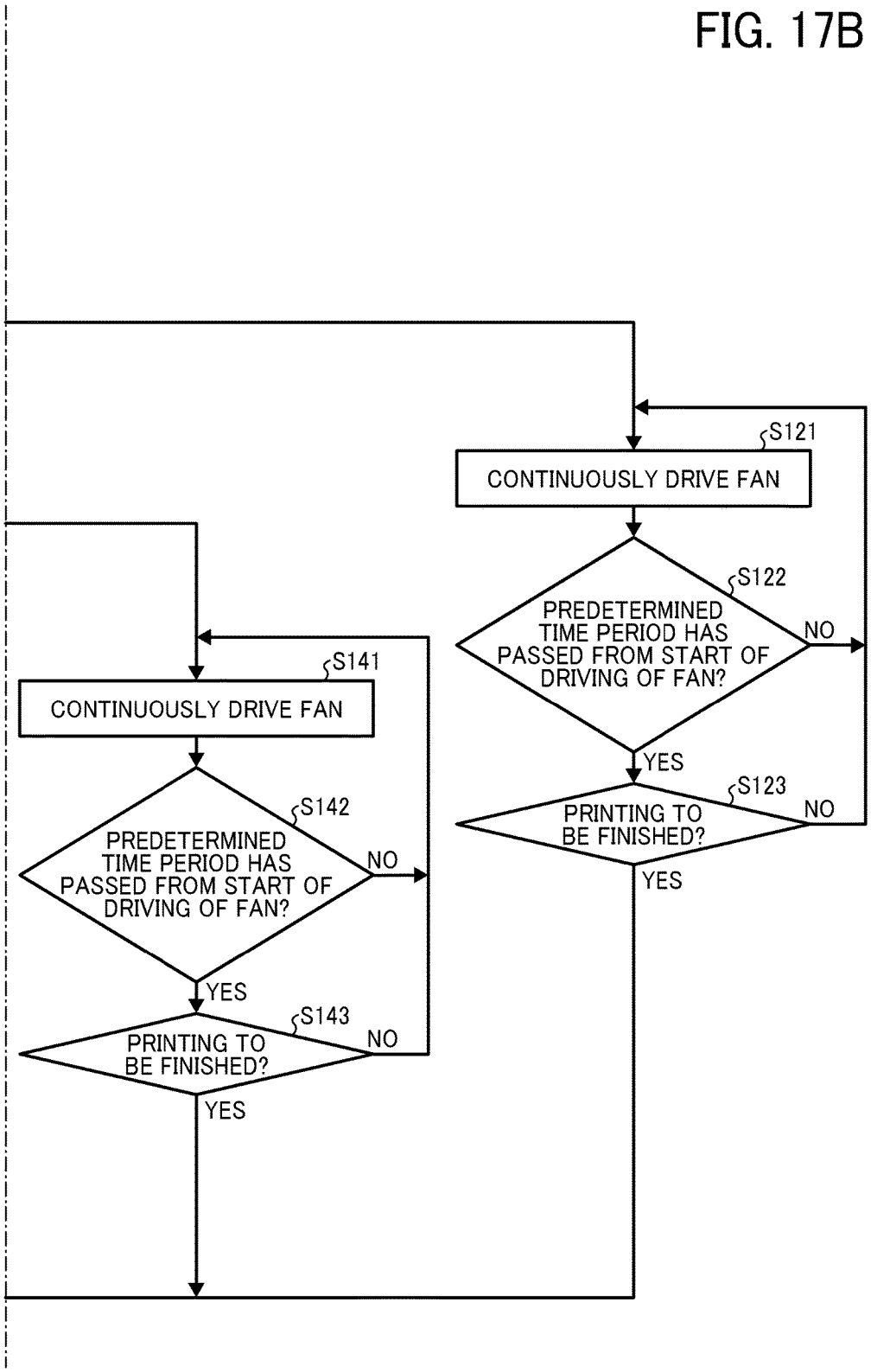

Next, referring to the flowchart of FIGS. 17A and 17B, a control procedure of the blower fan 121 will be described. As illustrated in FIGS. 17A and 17B, a printing operation is started, and the outside-air temperature by the outside-air temperature sensor 131 and the temperature around the charging device 3 by the temperature sensor 132 are detected step S111). Next, the controller 130 determines whether the detected outside-air temperature is lower than a cleaning failure temperature (step S112). Note that the cleaning failure temperature refers to a temperature around a cleaning device 5 at which the cleaning device 5 causes cleaning failure.

When the controller 130 has determined that the detected outside-air temperature is not lower than the cleaning failure temperature, the controller 130 controls the blower fan 121 to be continuously driven (step S121). Next, the controller 130 acquires a time from when the blower fan 121 starts the continuous driving from the time counter 180, and determines whether a predetermined time has passed from when the blower fan 121 starts the continuous driving (step S122). This predetermined time is a time when an ozone concentration around the charging device 3 reaches a reference value or less than the reference value how long outside air having the detected outside-air temperature is caused to flow to the detected temperature around the charging device 3. Then, the temperature around the charging device 3, the outside-air temperature, and the predetermined time are stored in the memory device 181 in advance in association with one another. When the controller 130 has determined that the predetermined time has not passed, the processing returns to step S121, and the controller 130 continuously drives the blower fan 121 until the predetermined time passes. When the controller 130 has determined that the predetermined time has passed, whether printing has been terminated is confirmed (step S123). When the printing has not been terminated, the processing proceeds to step S121, the controller 130 continuously drives the blower fan 121. When the printing has been terminated, the printing operation is terminated.

Meanwhile, in step S112, when the controller 130 has determined that the detected outside-air temperature is lower than the cleaning failure temperature, the controller 130 determines whether the temperature around the charging device 3 is in a high range (step S113).

When the controller 130 has determined that the temperature around the charging device 3 is in the high range, the controller 130 controls, as illustrated in (a), (d), and (g) of FIG. 8, the blower fan 121 based on the detected outside-air temperature (step S114). Next, the controller 130 determines whether the temperature around the charging device 3 is lower than the cleaning failure temperature (step S115). When the controller 130 has determined that the temperature around the charging device 3 is lower than the cleaning failure temperature, the controller 130 stops the blower fan 121 for a predetermined time, stops the image forming apparatus 100, and instructs the indicator 182 to output an abnormal alarm (step S151). Meanwhile, when the controller 130 has determined that the temperature around the charging device 3 is not lower than the cleaning failure temperature, the processing proceeds to step S116, and whether the printing is terminated is determined. When the printing has been determined to be terminated, the printing operation is terminated. Meanwhile, when the printing has been determined not to be terminated, the processing returns to step S114.

Meanwhile, in step S113, when the controller 130 has determined that the temperature around the charging device 3 is not in the high range, the controller 130 determines whether the temperature around the charging device 3 is in a moderate range (step S131).

When the controller 130 has determined that the temperature around the charging device 3 is in the moderate range, the controller 130 controls, as illustrated in (b), (e), and (h) of FIG. 8, the blower fan 121 based on the detected outside-air temperature (step S132). Next, the controller 130 determines whether the temperature around the charging device 3 is lower than the cleaning failure temperature (step S133). When the controller 130 has determined that the temperature around the charging device 3 is lower than the cleaning failure temperature, the controller 130 stops the blower fan 121 for a predetermined time, stops the image forming apparatus 100, and instructs the indicator 182 to output an abnormal alarm (step 151). Meanwhile, when the controller 130 has determined that the temperature around the charging device 3 is not lower than the cleaning failure temperature, the processing proceeds to step S134, and whether the printing is terminated is determined. When the printing is determined to be terminated, the printing operation is terminated. Meanwhile, when the printing has been determined not to be terminated, the processing returns to step S132.

Meanwhile, in step S131, when the controller 130 has determined that the temperature around the charging device 3 is not in the moderate range, the controller 130 controls the blower fan 121 to be continuously driven (step S141). Next, the controller 130 acquires the time from when the blower fan 121 starts the continuous driving from the time counter 180, and determines whether the predetermined time has passed from when the blower fan 121 starts the continuous driving (step S142). This predetermined time is a time when an ozone concentration around the charging reaches a reference value or less than the reference value how long outside air having the detected outside-air temperature is caused to flow to the detected temperature around the charging device 3. Then, the temperature around the charging device 3, the outside-air temperature, and the predetermined time are stored in a memory device 181 in advance in association with one another. When the controller 130 has determined that the predetermined time has not passed, the processing returns to step S141, and the controller 130 continuously drives the blower fan 121 until the predetermined time passes. When the controller 130 has determined that the predetermined time has passed, whether the printing has been terminated is confirmed (step S143). When the printing has not been terminated, the processing returns to step S141, the controller 130 continuously drives the blower fan 121. When the printing has been terminated, the processing terminates the printing operation.

Next, the function and effect of the present embodiment will be described. The controller 130 controls the blower fan 121 as described above, based on the detection value of the outside-air temperature sensor 131 and the detection value of the temperature sensor 132. Accordingly, the ozone concentration can be reduced and occurrence of image failure can be prevented without causing cleaning failure of photoconductors 2. Further, the present embodiment does not need to detect the ozone concentration, and thus can have an inexpensive configuration compared with the first embodiment.

In the second embodiment, the numbers of a duct 22 that leads the air to the image forming units 1Y, 1C, 1M, and 1Bk and the blower fan 121 are not limited to one. For example, a blower fan 121 and a duct 22 may be provided to an image forming unit 1Bk of image forming units 1Y, 1C, 1M, and 1Bk, and another one blower fan 121 and a common duct 22 that leads the air from the blower fan 121 to the image forming units 1Y, 1C, and 1M may be provided to the image forming units 1Y, 1C, and 1M. Further, two blower fans 121 and two ducts 22 are provided, and one blower fan 121 and one duct 22 may be used for two of the image forming units 1Y, 1C, 1M, and 1Bk. When the air is sent from one blower fan 121 to the plurality of image forming units 1Y, 1C, 1M, and 1Bk in this way, it is preferable to control the operation of the blower fan 121 based on the detection result of the image forming unit 1Y, 1C, 1M, or 1Bk having the lowest detection result of the temperature around the charging device 3. This is because the ozone concentration is high if the temperature around the charging device 3 is low, as illustrated in FIG. 6. Accordingly, finer control can be performed than the present embodiment. Further, the ducts 22 and the blower fans 121 are provided to the image forming units 1Y 1C, 1M, and 1Bk independently of one another. In that case, the controller 130 can separately perform control of the image forming units 1Y, 1C, 1M, and 1Bk. Therefore, when the ozone concentration varies in each of the image forming unit 1Y, 1C, 1M, and 1Bk, the blower fans 121 can be independently controlled and thus finer control can be performed. In the present embodiment, a case of four image forming units 1Y, 1C, 1M, and 1Bk have been described. However, the number of the image forming units 1Y, 1C, 1M, and 1Bk may be five or one (monochrome image forming apparatus). Note that the materials and the dimensions of the configurations introduced in the above embodiments are mere examples, and it is apparent that various materials and dimensions are selectable within a scope where the function and effect of the present disclosure can be provided.

Numerous additional modifications and variations are possible in light of the above teachings. It is therefore to be understood that, within the scope of the above teachings, the present disclosure may be practiced otherwise than as specifically described herein. With some embodiments having thus been described, it will be obvious that the same may be varied in many ways. Such variations are not to be regarded as a departure from the scope of the present disclosure and appended claims, and all such modifications are intended to be included within the scope of the present disclosure and appended claims.

What is claimed is:

1. An image forming apparatus comprising:

a latent image bearer;

a charger to charge a surface of the latent image bearer;

a blower to send air to around the charger;

a first detector to detect a temperature of the air to be sent to around the charger; and a second detector to detect a temperature around the charger, wherein the blower is configured to perform an operation based on at least one of a detection result of the first detector and a detection result of the second detector, and wherein, when the detection result of the first detector is relatively higher than a set temperature, the blower is configured to be continuously driven until an end of an image forming operation, regardless of the detection result of the second detector.

2. The image forming apparatus according to claim 1, wherein the blower is configured to send external or internal air of the image forming apparatus to around the charger.

3. An image forming apparatus comprising:

a latent image bearer;

a charger to charge a surface of the latent image bearer;

a blower to send air to around the charger;

a first detector to detect a temperature of the air to be sent to around the charger; and a second detector to detect a temperature around the charger, wherein the blower is configured to perform an operation based on at least one of a detection result of the first detector and a detection result of the second detector, wherein the detection result of the first detector and the detection result of the second detector belongs to at least one range of at least two classified ranges corresponding to a relative high and a relative low of the temperature detected with the first detector and the temperature detected with the second detector, and the operation of the blower is configured to be controlled based on the at least one range of at least two classified ranges to which the detection result of the first detector and the detection result of the second detector belong.

4. The image forming apparatus according to claim 3, wherein, in response to the detection result of the first detector belonging to a relatively highest range of the at least two classified ranges, the blower is configured to be continuously driven regardless of the detection result of the second detector.

5. The image forming apparatus according to claim 3, wherein, in response to a range to which the detection result of the second detector belongs being relatively lower than or equal to a range to which the detection result of the first detector belongs, the blower is configured to be continuously driven.

6. The image forming apparatus according to claim 3, wherein, in response to a range to which the detection result of the second detector belongs being relatively higher than a range to which the detection result of the first detector belongs, the blower is configured to be intermittently driven.

7. The image forming apparatus according to claim 3, wherein, in response to a range to which the detection result of the second detector belongs being relatively higher than a range to which the detection result of the first detector belongs, an output of the blower is configured to be set to be relatively smaller than an output of the blower set when the range to which the detection result of the first detector belongs is equal to the range to which the detection result of the second detector belongs.

8. The image forming apparatus according to claim 3, wherein, in response to the detection result of the first detector belonging to a relatively lowest range of the at least two classified ranges, a drive operation of the blower is configured to be changed according to a range to which the detection result of the second detector belongs.

9. The image forming apparatus according to claim 3, wherein, in response to a range to which the detection result of the second detector belongs being relatively higher than or equal to a range to which the detection result of the first detector belongs, a continuous drive time of the blower is configured to be changed according to a range to which the detection result of the first detector belongs.

10. An image forming apparatus comprising:

a latent image bearer;

a charger to charge a surface of the latent image bearer;

a blower to send air to around the charger;

a first detector to detect a temperature of the air to be sent to around the charger;

a second detector to detect a temperature around the charger; and a blower controller to control an operation of the blower based on a detection result of at least one of the first detector and a detection result of the second detector, wherein the blower controller is configured to control the blower to be continuously driven until an end of an image forming operation regardless of the detection result of the second detector in response to the detection result of the first detector is being relatively higher than a set temperature.

11. The image forming apparatus according to claim 10, wherein the detection result of the first detector and the detection result of the second detector belongs to at least one range of at least two classified ranges corresponding to a relative high and a relative low of the temperature detected with the first detector and the temperature detected with the second detector, and wherein the blower controller is configured to control the blower based on the at least one range of at least two classified ranges to which the detection result of the first detector and the detection result of the second detector belong.

12. The image forming apparatus according to claim 11, wherein, in response to the detection result of the first detector belonging to a relatively highest range of the at least two classified ranges, the blower controller is configured to control the blower to be continuously driven regardless of the detection result of the second detector.

13. The image forming apparatus according to claim 11, wherein, in response to a range to which the detection result of the second detector belongs being relatively lower than or equal to a range to which the detection result of the first detector belongs, the blower controller is configured to control the blower to be continuously driven.

14. The image forming apparatus according to claim 11, wherein, in response to a range to which the detection result of the second detector belongs being relatively higher than a range to which the detection result of the first detector belongs, the blower controller is configured to control the blower is configured to be intermittently driven.

15. The image forming apparatus according to claim 11, wherein, in response to a range to which the detection result of the second detector belongs being relatively higher than a range to which the detection result of the first detector belongs, the blower controller is configured to set an output of the blower to be relatively smaller than an output of the blower set when the range to which the detection result of the first detector belongs is equal to the range to which the detection result of the second detector belongs.

16. The image forming apparatus according to claim 11, wherein, in response to the detection result of the first detector belonging to a relatively lowest range of the at least two classified ranges, the blower controller is configured to control a drive operation of the blower to be changed according to a range to which the detection result of the second detector belongs.

17. The image forming apparatus according to claim 11, wherein, in response to a range to which the detection result of the second detector belongs being relatively higher than or equal to a range to which the detection result of the first detector belongs, the blower controller is configured to change a continuous drive time of the blower according to a range to which the detection result of the first detector belongs.

* * * * *